US005984653A

United States Patent [19]

Misiak

[11] Patent Number: 5,984,653

[45] Date of Patent: Nov. 16, 1999

[54] MECHANISM AND METHOD FOR ALIGNING A FIXED SCROLL IN A SCROLL COMPRESSOR

[75] Inventor: Michael W. Misiak, Monroe, Mich.

[73] Assignee: Tecumseh Products Company, Tecumseh, Mich.

[21] Appl. No.: 08/888,421

[22] Filed: Jul. 7, 1997

[51] Int. Cl.[6] ..... F04C 18/04

[52] U.S. Cl. ..... 418/55.1; 29/464; 29/888.022

[58] Field of Search ..... 418/55.1, 55.2; 29/464, 888.022

[56] References Cited

U.S. PATENT DOCUMENTS

| | | | |
|---|---|---|---|
| 3,924,977 | 12/1975 | McCullough | 418/55.2 |
| 5,106,279 | 4/1992 | Richardson, Jr. | 418/55.2 |
| 5,290,160 | 3/1994 | Ito et al. | 418/55.1 |
| 5,407,335 | 4/1995 | Caillat et al. | 418/55.1 |
| 5,411,384 | 5/1995 | Bass et al. | 418/55.6 |
| 5,527,166 | 6/1996 | Chang et al. | 418/55.2 |
| 5,551,851 | 9/1996 | Williams et al. | 418/55.5 |
| 5,557,845 | 9/1996 | Burkett et al. | 29/888.022 |
| 5,580,230 | 12/1996 | Keifer et al. | 418/55.5 |

FOREIGN PATENT DOCUMENTS

| | | | |
|---|---|---|---|
| 4116284 | 4/1992 | Japan | 418/55.1 |
| 5-18202 | 1/1993 | Japan | 29/888.022 |

*Primary Examiner*—John J. Vrablik
*Attorney, Agent, or Firm*—Baker & Daniels

[57] ABSTRACT

A method and mechanism for aligning a fixed scroll member relative to a main bearing member in a scroll compressor. A shoulder is machined on the outer perimeter of a main bearing member and interfits with an arcuate lip on the fixed scroll member to thereby center the fixed scroll member. A notch is machined into the arcuate lip of the fixed scroll member and receives a projecting pin disposed on the main bearing member when the fixed scroll is assembled to the main bearing member. Relative rotation of the fixed scroll member and main bearing member brings one edge of the projecting pin into engagement with an abutment surface defining one end of the notch and thereby properly rotationally positioning the fixed scroll member. The fixed scroll member is subsequently axially secured to the main bearing member with a plurality of bolts.

17 Claims, 3 Drawing Sheets

MECHANISM AND METHOD FOR ALIGNING A FIXED SCROLL IN A SCROLL COMPRESSOR

BACKGROUND OF THE INVENTION

1. Field of the Invention

The present invention relates to scroll compressors and, more particularly, to mechanisms and methods for aligning a fixed scroll member relative to a main bearing member in a scroll compressor.

2. Description of the Related Art

Scroll compressors are well known in the art and utilize a fixed scroll member having an involute wrap and a moveable scroll member also having an involute wrap to compress a fluid, typically a refrigerant. The scroll members are positioned with the involute wraps in mutual engagement. The mutually engaged wraps form compression pockets which confine the fluid. The compression pockets progressively decrease in size as they travel towards the center of the scroll members as the moveable scroll member is orbited relative to the fixed scroll.

The moveable scroll member is eccentrically mounted on a crankshaft to provide for the orbital movement of the moveable scroll. The crankshaft is, in turn, supported by a main bearing member. An anti-rotation device is used to prevent the moveable scroll from rotating about its own axis as it is orbited relative to the crankshaft axis by rotation of the crankshaft. The anti-rotation device, often comprising an Oldham ring, is commonly placed between and in engagement with both the main bearing member and the moveable scroll member.

Improper relative positioning of the two scroll members can lead to gaps between the involute wraps and leakage of fluid from individual compression pockets thereby leading to inefficient operation of the compressor. The mounting of the moveable scroll member to the crankshaft controls the position of the moveable scroll member relative to the main bearing. The position of the fixed scroll member relative to the main bearing member is commonly achieved by directly attaching the fixed scroll member to the main bearing member which thereby relatively positions the fixed and moveable scroll members. The fixed scroll may be either axially secured to the main bearing member or mounted in an axially compliant manner which permits relative axial movement between the fixed scroll member and main bearing member.

SUMMARY OF THE INVENTION

The present invention provides a mechanism and method of accurately aligning a fixed scroll relative to the main bearing in an axially secure fashion.

The invention comprises, in one form thereof, a fixed scroll having an arcuate projecting lip which interfits with a recessed shoulder on the main bearing member of the scroll compressor. The interfitting lip and shoulder center the fixed scroll member relative to the main bearing member. The main bearing member further includes a precision hole in the recessed shoulder into which a pin is inserted. The projecting lip of the fixed scroll includes a notch into which the pin projects. The fixed scroll and main bearing are circumferentially aligned by rotating the fixed scroll relative to the main bearing to position the pin against one end of the notch. After the fixed scroll and main bearing have been centered and rotationally positioned, bolts are used to axially secure the fixed scroll member and main bearing member.

An advantage of the present invention is that it provides a mechanism for accurately centering the fixed scroll member.

Another advantage of the present invention is that it provides a mechanism for accurately "clocking" or rotationally positioning the fixed scroll member.

Yet another advantage of the present invention is that it provides an improved method of assembling a scroll compressor having an accurately positioned fixed scroll member.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
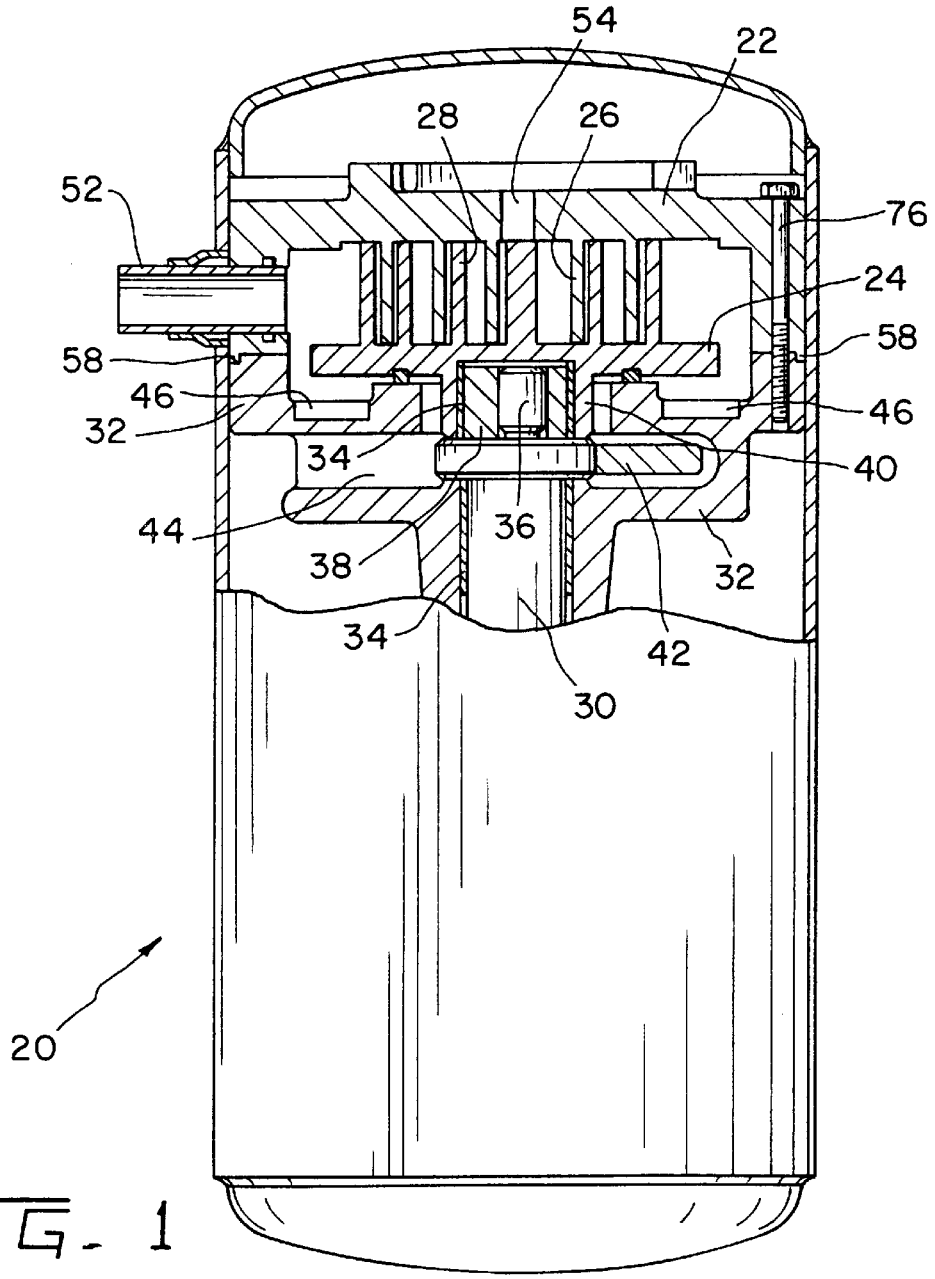
FIG. 1 is a partially cross sectional view of a scroll compressor in accordance with the present invention.

Corresponding reference characters indicate corresponding parts throughout the several views. Although the drawings represent an embodiment of the present invention, the drawings are not necessarily to scale and certain features may be exaggerated. The embodiment described below is set out as an exemplification of the invention. The described embodiment is not intended to be exhaustive or to be construed as limiting the scope of the invention to the precise form disclosed.

DESCRIPTION OF THE PRESENT INVENTION

Referring now to the drawings and particularly to FIG. 1, there is shown a scroll compressor 20 in accordance with the present invention. Scroll compressor 20 includes a fixed scroll member 22 and a moveable scroll member 24. The fixed and moveable scroll members 22, 24 each have a volute shaped wrap 26 and 28 respectively. The scroll wraps 26, 28 interfit and are used to compress gases in a well known manner by orbiting the moveable scroll member 24 relative to the fixed scroll member 22.

The moveable scroll member 24 is eccentrically mounted on crankshaft 30 and orbited about the axis of the crankshaft 30. As moveable scroll member 24 is orbited, a fluid is compressed between the two scroll wraps 26, 28. Scroll compressors are well-known in the art and the disclosure of U.S. Pat. Nos. 4,846,635; 5,131,828; and 5,383,772, assigned to the assignee of the present invention, provide disclosures of the structure and operation of exemplary scroll compressors which are expressly incorporated herein by reference.

Main bearing member 32 includes conventional sleeve bearings 34 which are press fit therein. Crankshaft 30 is rotatably journaled within sleeve bearings 34 and thereby supported by main bearing member 32. Crankshaft 30 includes an eccentric crankpin 36 which is received within an off-center axial bore located in a cylindrical roller 38. Cylindrical roller 38 is disposed within a lower hub 40 of orbiting scroll member 24 thereby causing orbiting scroll member 24 to orbit fixed scroll member 22 as crankshaft 30 is rotated. A counterweight 42 is attached to crankshaft 30 and rotates in cavity 44 of main bearing member 32 to offset the eccentrically mounted orbiting scroll member 24.

Figure 4:
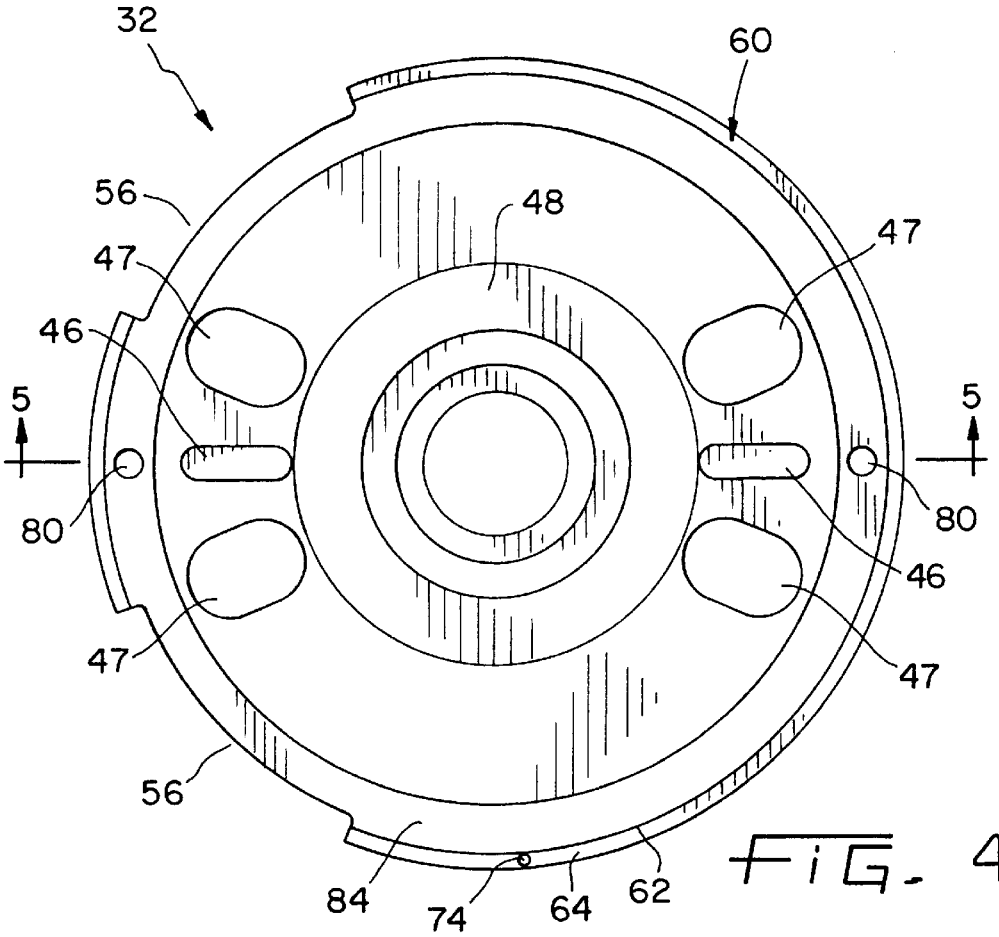
FIG. 4 is a top view of the main bearing member of FIG. 1.
Figure 5:
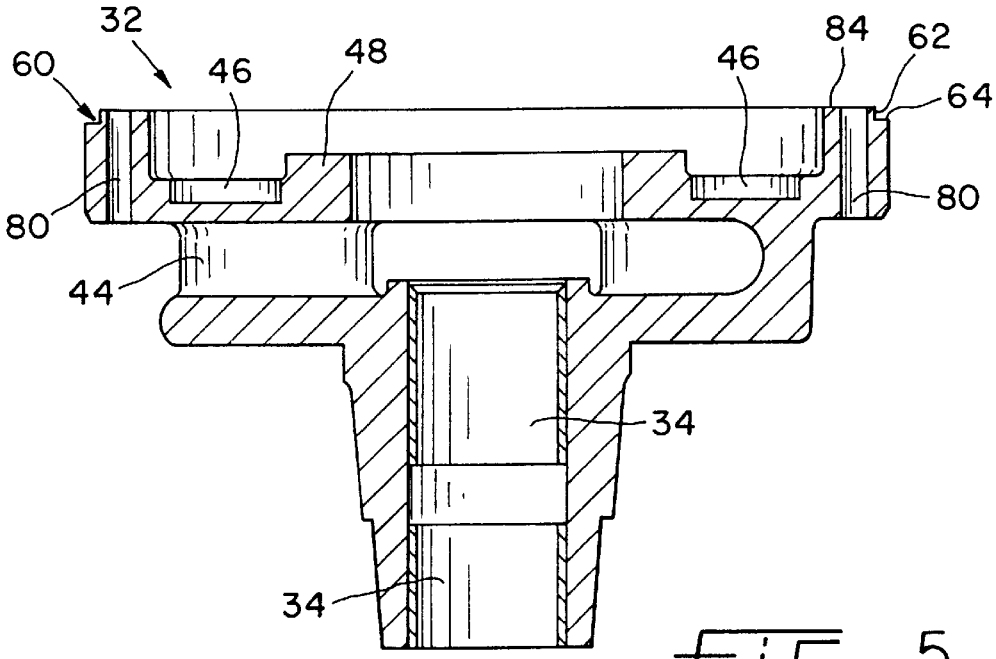
FIG. 5 is a sectional view of the main bearing member taken along line 5—5 of FIG. 4.

To prevent moveable scroll 24 from rotating about its own axis as it is orbiting, an anti-rotation device is employed. The anti-rotation device utilized by the illustrated embodiment is a conventional Oldham ring (not shown) well known in the art. The Oldham ring includes an annular member having two pairs of keys. The first pair of projecting keys are located diametrically opposite one another on the annular member. The second pair of keys are also located on the annular member diametrically opposite one another, but are offset from the first pair of keys by 90° and project in the opposite direction relative to the projecting direction of the first pair of keys. The first pair of keys project into keyways 46 disposed on the main bearing member 32 while the second pair of keys project into keyways (not shown) disposed on rear surface of orbiting scroll member 24. As can be seen in FIG. 4, oil relief pockets 47 in main bearing member 32 are disposed adjacent keyways 46.

In operation, refrigerant fluid at suction pressure is introduced through a suction tube 52 into the working space of compressor 20. As moveable scroll member 24 is orbited, refrigerant fluid within the working space of the compressor is compressed and travels radially inwardly within moving closed pockets defined by fixed wrap 26 and moveable wrap 28. Refrigerant fluid at discharge pressure in the innermost pocket between the wraps is discharged upwardly through discharge port 54. Fixed scroll member 22 includes passageways 57 along its outer perimeter to permit the axial transport of the pressurized fluid. Main bearing member 32 includes similar passageways 56 in communication with passageways 57.

Main bearing member 32 also includes an annular thrust pad 48 disposed adjacent the rear surface of orbiting scroll member 24. An annular seal 50 is disposed between orbiting scroll member 24 and annular pad 48. During operation of compressor 20, annular seal 50 sealingly separates a radially inward high pressure space at discharge pressure from a radially outward low pressure space at suction pressure to thereby form an axial compliance mechanism. The pressurized fluid being compressed in the inner pockets tends to force the scroll members 22, 24 axially apart. The high pressure zone radially inward of seal 50 axially biases the orbiting scroll member 24 into engagement with fixed scroll member 22 to overcome these separating axial forces generated during operation of compressor 20. Axial compliance means are well known in the art, and alternative axial compliance mechanisms may also be used with the present invention.

The axial compliance mechanism is utilized to help maintain proper engagement of the wrap tips of wraps 26, 28 with the scroll face of the opposing scroll member. The scroll members 22, 24, however, must also be properly centered and rotationally aligned to achieve effective mutual sealing engagement of wraps 26, 28 and thereby effectively form and seal individual compression pockets during operation of compressor 20.

The moveable scroll member 24 is positioned relative to the axis of crankshaft 30 by eccentrically mounting moveable scroll member 24 to the crankshaft as described above. Main bearing member 32 supports crankshaft 30 and, thus, defines the position of the crankshaft axis. Fixed scroll member 22 is coaxially positioned relative to the crankshaft axis, i.e., centered, by affixing scroll member 22 to main bearing member 32. Centering fixed scroll member 22 relative to the crankshaft axis also positions fixed scroll member 22 relative moveable scroll member 24 eccentrically mounted on crankshaft 30.

To center fixed scroll member 22, a boss, located on fixed scroll member 22, is engaged with an alignment element on main bearing member 32. It is also possible to utilize a boss located on the main bearing member 32 to engage an alignment element on the fixed scroll member 22. In the illustrated embodiment, an arcuate lip 58 disposed along the outer perimeter of fixed scroll member 24 forms a boss which engages an alignment element, i.e., recess 60, on main bearing member 32. Recess 60 is located on the outer perimeter of main bearing member 32 and forms a shoulder thereon. Inner diameter surface 59 of arcuate lip 58 is machined concentric with fixed wrap 28 using conventional machining methods and faces radially inward. Recess, or shoulder, 60 is also machined with conventional manufacturing methods and defines an outer diameter surface 62 which faces radially outward and channel surface 64. Outer diameter surface 62 and inner diameter surface 59 are mutually engageable and their engagement centers fixed scroll member 22 relative to main bearing member 32 and the crankshaft and moveable scroll member assembly supported thereon. Outer diameter surface 62 and inner diameter surface 59 thereby form alignment surfaces.

Alignment surfaces 59 and 62 are cylindrically shaped and are centered on the axis of crankshaft 30, i.e., surfaces 59 and 62 are positionable on the boundary of an imaginary cylindrical space which is disposed concentrically with crankshaft 30 when compressor 20 is assembled. As can be seen in the Figures, alignment surfaces 59 and 62 are broken by passageways 57 and 56 and do not entirely encircle fixed scroll member 22 and main bearing member 32. Surfaces 59 and 62 are also rotationally slidably engageable, in other words, fixed scroll member 22 and main bearing member 32 can be relatively rotated when surfaces 59 and 62 are engaged.

Scroll members 22, 24 must be rotationally aligned in addition to being properly positioned relative to the crankshaft axis. Moveable scroll member 24 has keyways which engage projecting keys from an Oldham ring which also has a pair of keys engaging keyways 46 on main bearing member 32. The Oldham ring not only prevents rotation of moveable scroll member 24 but also rotationally positions moveable scroll member 24 relative to main bearing member 32. Rotationally aligning fixed scroll member 22 relative to main bearing member 32 will thereby rotationally align fixed scroll member 22 relative to moveable scroll member 24.

To rotationally align fixed scroll member 22, a notch 66 is machined in arcuate lip 58. One end of the notch is defined by abutment surface 68 which is placed at a predetermined rotational position on fixed scroll member 22 and disposed in a plane which intersects inner diameter surface 59 at an approximately 90° angle. A clocking member on main bearing member 32 is also placed at a predetermined rotational position whereby main bearing member 32 and fixed scroll member 22 will be properly positioned when the clocking member bears against abutment surface 68. In the illustrated embodiment, the clocking member comprises a pin 70 disposed in a precision drilled hole 74. Hole 74 is drilled in channel surface 64 using conventional manufacturing methods and can be seen in FIG. 4. Pin 70 is a split pin, taking the general form of a hollow tube cut lengthwise, having an outer diameter slightly larger than the inner diameter of hole 74. The hollow interior of pin 70 collapses when pin 70 is inserted into, and tightly engaged by, hole 74. Pin 70 is inserted into hole 74 prior to centering fixed scroll member 22 and main bearing member 32. A clocking member integral with main bearing member 32 and projecting from recess 60 could also be formed during the machining of recess 60.

Figure 6:
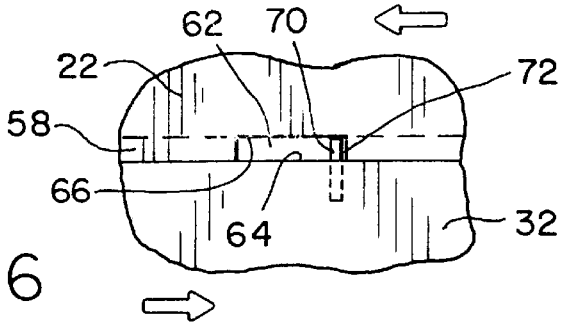
FIG. 6 is a view of a pin and notch used to rotationally align the fixed scroll member and main bearing member.
Figure 2:
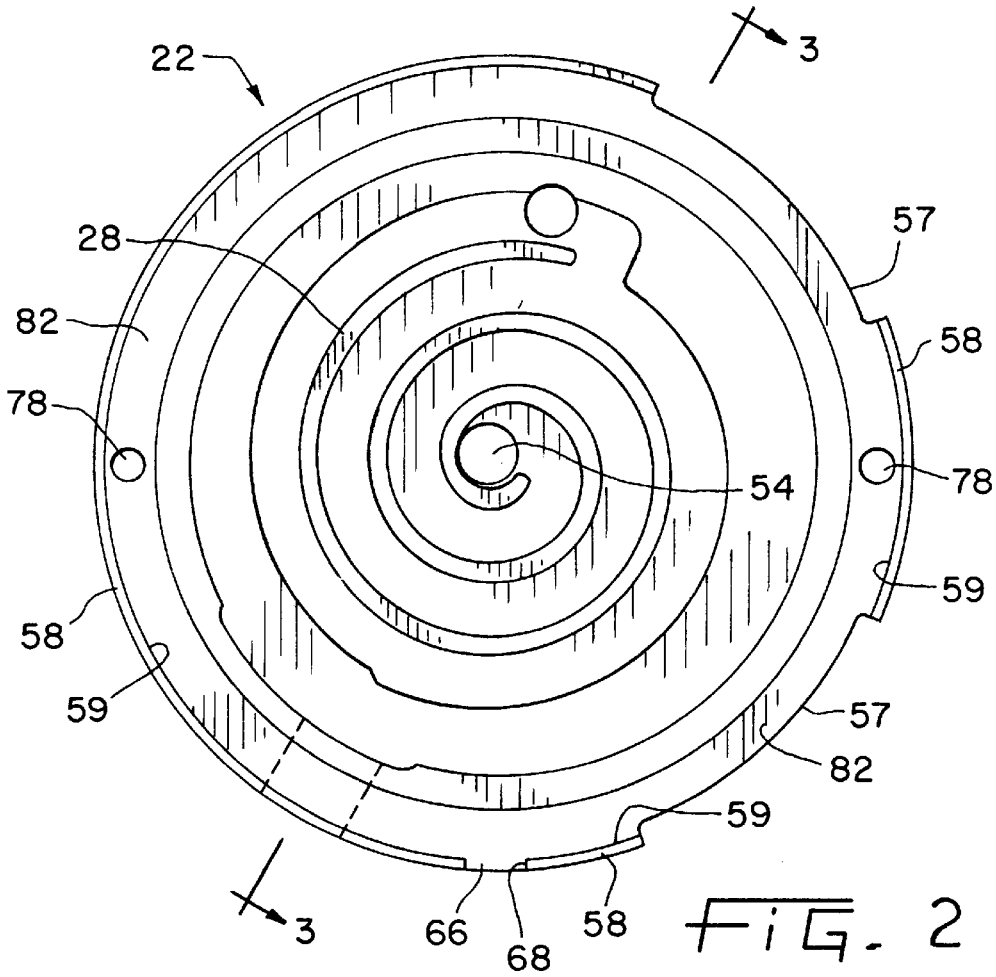
FIG. 2 is a bottom view of the fixed scroll member of FIG. 1.
Figure 3:
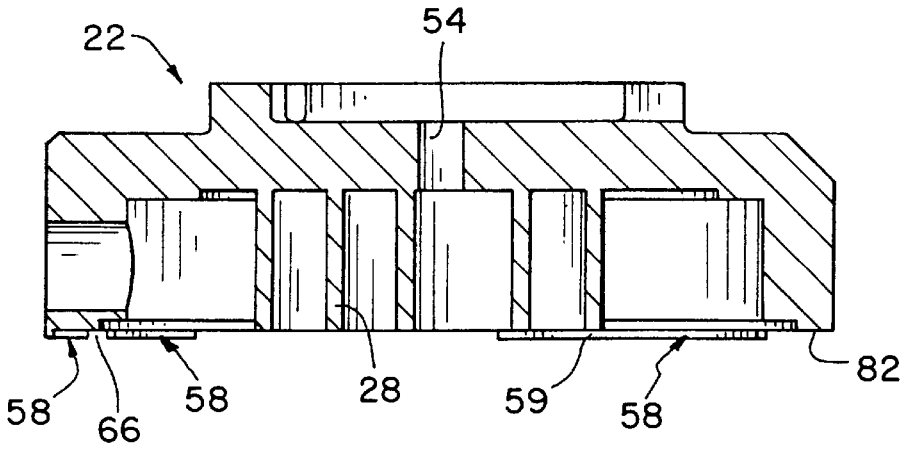
FIG. 3 is a sectional view of the fixed scroll member taken along line 3—3 of FIG. 2.

As can be seen in FIG. 6, notch 66 is considerably larger than pin 70 and pin 70 is inserted into notch 66 when arcuate lip 58 and recess 60 are brought into mutual engagement to center fixed scroll member 22. After mutually engaging lip 58 and recess 60, fixed scroll member 22 and main bearing member 32 are relatively rotated until an edge 72 of pin 70 engages abutment surface 68. The arrows in FIG. 6 indicate the relative rotation of fixed scroll member 22 and main bearing member 32 just prior to engagement of edge 72 and abutment surface 68. When edge 72 and abutment surface 68 are mutually engaged, fixed scroll member 24 is properly rotationally positioned.

While the illustrated embodiment utilizes a pin projecting from the main bearing member to engage an abutment surface on a boss located on the fixed scroll member, it is not necessary that the abutment surface be located on the boss or that the clocking member be located on the main bearing member to employ the present invention and alternative configurations are also possible. For example, the pin could project from the fixed scroll member and engage an abutment surface disposed on the main bearing member or the clocking member could be formed integrally with either the fixed scroll member or the main bearing member. It is also possible to locate the clocking member and abutment surface at points which are spaced from alignment surfaces 59 and 62.

After properly positioning fixed scroll member 22, it is secured to main bearing member 32 utilizing a plurality of fasteners or other suitable means. In the illustrated embodiment, bolts 76 are used to axially secure fixed scroll member 22 to main bearing member 32. Bolts 76 are inserted through apertures 78 in fixed scroll member 22 and engage apertures 80 in main bearing member 32. Pin 70 is used merely to properly rotationally position, or "clock", fixed scroll member 22 and is not used to resist rotational movement of fixed scroll member 22. Tightening of bolts 76 axially secures fixed scroll member 22 to main bearing member 32 and also prevents relative rotational movement between the fixed scroll member 22 and main bearing member 32 by securely engaging surfaces 82 and 84 which are respectively disposed on fixed scroll member 22 and main bearing pad 32. Engagement of inner diameter surface 59 and outer diameter surface 62 prevents fixed scroll member 22 from moving radially inward or outward after assembly of compressor 20. Although engagement of surfaces 59 and 62 resist radially inward and outward movement in the illustrated embodiment, the engagement of surfaces 82 and 84 also provides resistance to radially inward and outward movement of fixed scroll member 22.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains. Accordingly, the scope of the invention should be determined not by the illustrated embodiment but by the following claims and their equivalents.

What is claimed is:

1. A scroll compressor comprising:

a main bearing member supporting a crankshaft;

a moveable scroll member mounted on said crankshaft;

a fixed scroll member disposed in operative cooperation with said moveable scroll member whereby orbital movement of said moveable scroll member compresses a fluid; and an alignment mechanism securely positioning said fixed scroll relative to said main bearing member, said alignment mechanism comprising:

an extending boss having a first alignment surface, said boss disposed on a first one of said fixed scroll member and said main bearing member;

an alignment element having a second alignment surface, said alignment element disposed on the first other of said fixed scroll member and said main bearing member, said first and second alignment surfaces each concentric with said crankshaft and adapted for mutual engagement, said mutual engagement of said alignment surfaces centering said fixed scroll member relative to said crankshaft, said alignment surfaces disposed to resist radial movement of said fixed scroll member relative to said crankshaft axis;

a clocking member having an edge, said clocking member disposed on a second one of said fixed scroll member and said main bearing member;

an abutment surface disposed on the second other of said fixed scroll member and said main bearing member, said edge being adapted for engagement with said abutment surface upon relative rotation of said fixed scroll member and said main bearing member about said crankshaft axis whereby said fixed scroll member may be rotationally positioned relative to said main bearing member; and a fastener axially fixing said fixed scroll member to said main bearing member.

2. The scroll compressor of claim 1 wherein said extending boss comprises an arcuate lip and said first alignment surface is disposed on said lip and is disposed on a boundary of a cylindrical space disposed concentrically with said crankshaft.

3. The scroll compressor of claim 1 wherein said clocking member comprises a pin partially disposed within a hole.

4. The scroll compressor of claim 1 wherein said abutment surface is disposed on said extending boss.

5. The scroll compressor of claim 1 wherein said boss comprises an extending arcuate lip disposed on an outer perimeter of said fixed scroll member concentrically with an involute wrap disposed on said fixed scroll member; said alignment element comprises an arcuate shoulder on an outer perimeter of said main bearing member; said clocking member comprises a pin extending from a hole in said shoulder; and said arcuate lip includes a notch therein, an end of said notch defining said abutment surface.

6. A scroll compressor comprising:

a main bearing member supporting a crankshaft;

a moveable scroll member mounted on said crankshaft;

a fixed scroll member disposed in operative cooperation with said movable scroll member whereby orbital movement of said moveable scroll member compresses a fluid; and an alignment mechanism securely positioning said fixed scroll member relative to said main bearing member, said alignment mechanism comprising:

an arcuate extending lip disposed on an outer perimeter of said fixed scroll member, said lip including a notch therein;

an arcuate surface disposed along an outer perimeter of said main bearing member, said arcuate surface and said arcuate extending lip adjacent one another;

a clocking member extending from said main bearing member, said clocking member substantially smaller than said notch and engaging an abutment surface, said abutment surface defining one end of said notch; and a fastener axially securing said fixed scroll member to said main bearing member.

7. The scroll compressor of claim 6 wherein said lip and said arcuate surface are rotationally slidably engageable during assembly of said scroll compressor.

8. The scroll compressor of claim 6 wherein said clocking member comprises a pin extending from a hole disposed in said main bearing member.

9. The scroll compressor of claim 6 wherein said fastener comprises a plurality of bolts.

10. A method of assembling a scroll compressor, said method comprising:

providing a main bearing member adapted for supporting a crankshaft and moveable scroll member assembly;

providing a fixed scroll member adapted for cooperation with the moveable scroll member;

centering the fixed scroll relative to the main bearing member by engaging an extending boss disposed on one of said fixed scroll member and said main bearing member with a cooperating alignment surface disposed on the other of said fixed scroll member and said main bearing member;

rotationally positioning the fixed scroll relative to the main bearing member by relatively rotating said fixed scroll member and said main bearing member until a clocking member disposed on a second one of said fixed scroll member and said main bearing member engages an abutment surface disposed on the second other of said fixed scroll member and said main bearing member; and axially fixing the fixed scroll member to the main bearing member.

11. The method of claim 10 wherein said extending boss comprises an arcuate lip disposed on outer perimeter of said fixed scroll member and said alignment surface comprises an arcuate shoulder disposed on an outer perimeter of said main bearing member.

12. The method of claim 10 wherein said clocking member comprises a pin extending from a hole in said second one of said fixed scroll member and said main bearing member and said abutment surface is disposed on said extending boss.

13. The method of claim 10 wherein said extending boss comprises an arcuate lip disposed on an outer perimeter of said fixed scroll member and said alignment surface comprises an arcuate shoulder disposed on an outer perimeter of said main bearing member; said clocking member comprises a pin extending from a hole disposed in said shoulder and said abutment surface is disposed on said arcuate lip; and wherein said step of axially securing said fixed scroll member comprises securing said fixed scroll member to said main bearing member with a plurality of bolts.

14. A method of assembling a scroll compressor, said method comprising:

providing a main bearing member adapted for supporting a crankshaft and moveable scroll member assembly;

machining a shoulder along an outer perimeter of said main bearing member;

drilling a hole in said shoulder;

inserting a pin in said hole;

providing a fixed scroll member adapted for cooperation with the moveable scroll member;

providing an extending lip near an outer perimeter of said fixed scroll member;

machining a notch in said lip;

centering said fixed scroll member relative to said main bearing by engaging said lip and said shoulder whereby said pin projects into said notch;

relatively rotating said fixed scroll member and said main bearing member until said pin engages an abutment surface defining an end of said notch; and axially securing said fixed scroll member to said main bearing member.

15. The method of claim 14 further comprising the step of machining a radially inward facing surface on said lip to mate with a radially outward facing surface defining a portion of said shoulder.

16. The method of claim 15 wherein said radially inward and radially outward facing surfaces are disposed concentrically with said crankshaft after assembly of said compressor.

17. The method of claim 14 wherein said step of axially securing said fixed scroll member comprises securing said fixed scroll member to said main bearing member with a plurality of bolts.

* * * * *